United States Patent [19]

Gupta

[11] Patent Number: 4,668,259

[45] Date of Patent: May 26, 1987

[54] CHEMICAL REFRIGERATION SYSTEM

[75] Inventor: Ashis S. Gupta, Marietta, Ga.

[73] Assignee: The Coca-Cola Company, Atlanta, Ga.

[21] Appl. No.: 700,904

[22] Filed: Feb. 12, 1985

[51] Int. Cl.[4] ..... F25D 5/00

[52] U.S. Cl. ..... 62/4; 62/76; 62/330

[58] Field of Search ..... 62/4, 76, 330; 165/1, 165/2, DIG. 17, 104.12, 108

[56] References Cited

U.S. PATENT DOCUMENTS 1,894,775 1/1933 Levenson ..... 62/4

4,161,210 7/1979 Reid et al. ..... 62/4

*Primary Examiner*—Frank Sever

*Attorney, Agent, or Firm*—Birch, Stewart, Kolasch & Birch

[57] ABSTRACT

A chemical refrigeration system utilizes the endothermic reaction of chemicals such as potassium chloride dissolved in water to refrigerate the water. To achieve a large drop in water temperature, plural stages of endothermic reactions are utilized in a plurality of chillers to chill the water in increments. Heat exchangers are also provided in recirculation paths of the chillers to increase efficiency. The system will operate successfully in the zero gravity conditions of outer space.

11 Claims, 3 Drawing Figures

CHEMICAL REFRIGERATION SYSTEM

BACKGROUND OF THE INVENTION

The present invention relates to a refrigeration system suitable for use in the zero gravity conditions of outer space. More specifically, the present invention relates to a chemical refrigeration system in which a liquid is chilled from the endothermic reaction associated with dissolving selected chemicals in the liquid.

Conventional mechanical refrigeration systems, which operate on the principles of vapor compression and utilize conventional components such as mechanical compressors and condensers, will not work properly in the zero gravity conditions of outer space because vapor cannot be separated from liquid without a great deal of difficulty under these conditions. Accordingly, when it is desired to chill or refrigerate liquids in outer space, conventional vapor compression systems may not be utilized.

The present invention takes advantage of the fact that certain chemicals, when dissolved in a liquid such as water, produce an endothermic reaction. This endothermic reaction cools the liquid down below the ambient temperature. The degree of cooling depends on the nature of the chemical used. However, the amount of cooling is proportional to the amount of the chemical which may be dissolved in the associated liquid, which is fixed by the solubility limitations of the chemical. Therefore, for any given volume of liquid and associated chemical to be dissolved therein, there is a limit on the amount of cooling that can be achieved, namely, the drop in temperature of the resulting solution, as compared to the original temperature of the liquid. Therefore, if one wants to chill a liquid from, for example 82° F. to 36° F., such a drop in temperature is difficult to obtain merely by dissolving a quantity of a selected chemical in an associated liquid.

Accordingly, a need in the art exists for a refrigeration system which utilizes the principles of chemical refrigeration achieved by dissolving a selected chemical in water, but utilizes the chemical/liquid solution in a system in such a manner that larger temperature drops can be achieved than normally permitted by the solubility limitations of the chemicals utilized.

SUMMARY OF THE INVENTION

Accordingly, it is a primary object of the present invention to provide a refrigeration system suitable for use in outer space under zero gravity conditions.

It is another object of the present invention to provide a chemical refrigeration system which can achieve large drops in liquid temperatures not limited by the solubility limitations of a selected chemical dissolved in a liquid.

It is a further object of the present invention to provide a chemical refrigeration system which will operate successfully with only a minimal amount of external energy being applied thereto.

It is still a further object of the present invention to provide a chemical refrigeration sytem suitable for use in outer space in combination with a post-mix, carbonated beverage dispensing system.

The objects of the present invention are fulfilled by providing a chemical refrigeration system for chilling a liquid from a first temperature to at least a second temperature by means of an endothermic reaction of selected chemicals dissolved in the liquid comprising:

a source of liquid at said first temperature;

a source of said selected chemical;

chiller means having reservoir means in which a predetermined quantity of said selected chemical is dissolved in a predetermined quantity of said liquid to create said endothermic reaction and a resulting cooling solution, said cooling solution having a temperature intermediate said first and second temperatures, and a conduit passing through said reservoir means in heat transfer contact with said cooling solution, said conduit having an input end and an output end for passing said liquid to be chilled, said reservoir means having an inlet for introducing said liquid into said reservoir and an outlet for accommodating the flow of said cooling solution out of said reservoir means;

heat exchanger means having a first inlet connected to said source of liquid at said first temperature, a second inlet connected to said outlet of said reservoir means for receiving said cooling solution, a heat exchange chamber for transferring heat between said liquid at said first temperature and said cooling solution to lower the liquid to a temperature intermediate said temperature and the temperature of said cooling solution, and an outlet for said liquid of intermediate temperature coupled to said input end of said conduit and the inlet of said reservoir means;

pump means for circulating said liquid through said system from said source of liquid to the output end of said conduit, said liquid exiting from the output end of said conduit at said second temperature.

The heat exchanger makes use of the cooling solution formed in a chiller means to recirculate the same into thermal contact with the source of liquid at the first temperature. Accordingly, this recirculation of the cooling solution cools the liquid down which enters the chiller means to lower the temperature drop requirements of the chiller means. Therefore, the temperature drop or delta achieved are not limited by the solubility of the selected chemical in the liquid within the reservoir means of the chiller.

In order to add even further efficiency to the refrigeration system, a second chiller means may be provided in tandem with the first chiller means. The second chiller means has a second reservoir for containing a second cooling solution, said first cooling solution being formed by dissolving a first supply of said selected chemical into liquid entering the reservoir means of the first chiller means from the ouput of the heat exchanger means. The second cooling solution is formed by dissolving a second supply of selected chemical into liquid contained in the second reservoir of the second chiller. The liquid in the second reservoir of the second chiller is supplied from the output end of the conduit, which passes through the first cooling solution in the first reservoir. A second heat exchanger may also be provided, having a first inlet connected to the source of liquid to be chilled at said first temperature, a second inlet connected to an outlet from said second reservoir, a heat exchange chamber for transferring heat between said second cooling solution and said liquid at said first temperature, to lower the liquid to a temperature intermediate said first temperature and the temperature of said second cooling solution, and an outlet for the liquid coupled to the input end of a second conduit. The second conduit passes through the second cooling solution in the reservoir of the second chiller means in heat transfer contact therewith, to cool the liquid to a third temperature below the second temperature. The refrigerated liquid output from the output end of the second conduit is then utilized in an appropriate manner.

BRIEF DESCRIPTION OF THE DRAWINGS

The objects of the present invention and the attendant advantages thereof will become more readily apparent by reference to the drawings wherein like reference numerals refer to like parts and.

DESCRIPTION OF PREFERRED EMBODIMENTS

Figure 1:
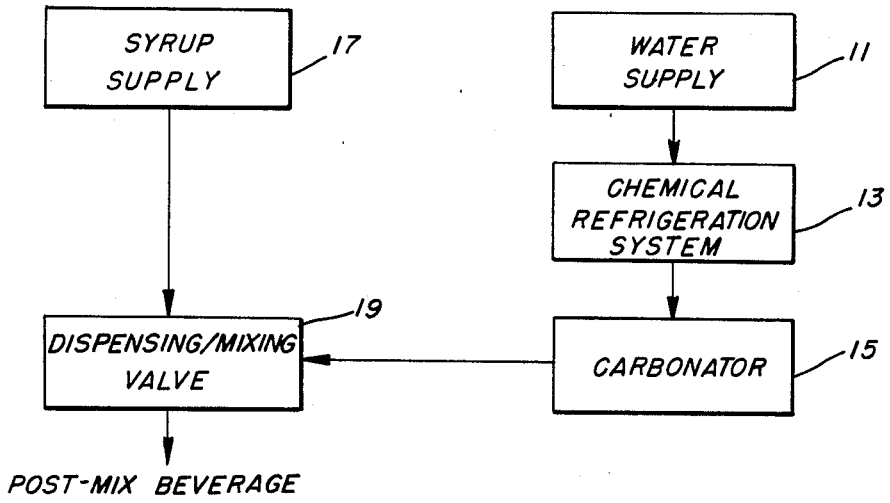
FIG. 1 is a schematic block diagram illustrating a post-mix beverage dispenser system including the chemical refrigeration system of the present invention therein.

Referring to FIG. 1, there is generally illustrated a post-mix beverage dispensing system including a water supply 11, a chemical refrigeration system 13 for chilling water provided by supply 11, a carbonator 15 for carbonating the chilled water, and a syrup supply 17 for providing syrup or flavor concentrate to a dispensing-/mixing valve 19 for mixing with carbonated water in desired proportions to form a post-mix beverage. FIG. 1 generally includes conventional components with the exception of the chemical refrigeration system 13. In conventional systems, refrigeration system 13 would normally be a mechanical refrigeration system including a compressor and condensor. However, when it is desired to make and dispense carbonated beverages in outer space, the conventional vapor compression refrigeration systems will not operate satisfactorily under zero gravity conditions. Accordingly, the present invention relates to the development of a chemical refrigeration system 13, as embodied in FIGS. 2 and 3, to satisfactorily refrigerate a liquid such as water in the zero gravity conditions of outer space.

Figure 3:
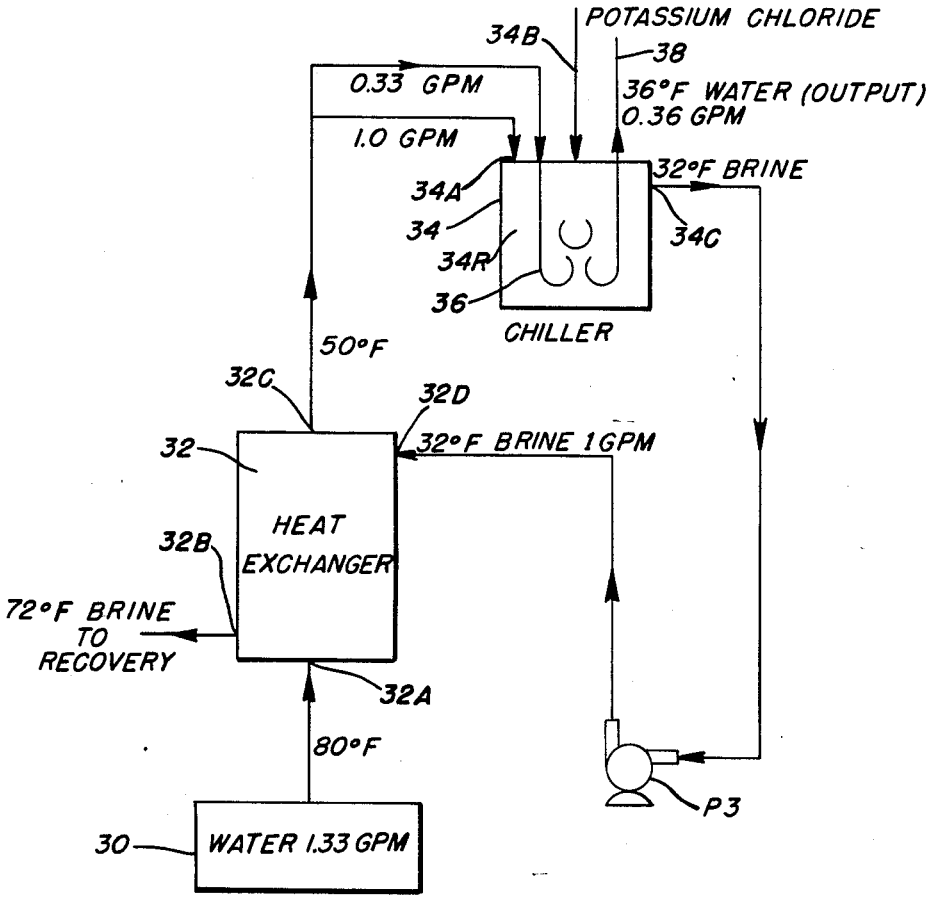
FIG. 3 is a second embodiment of a chemical refrigeration system suitable for use, for example, as the chemical refrigeration system in the post-mix beverage dispenser system of FIG. 1.
Figure 2:
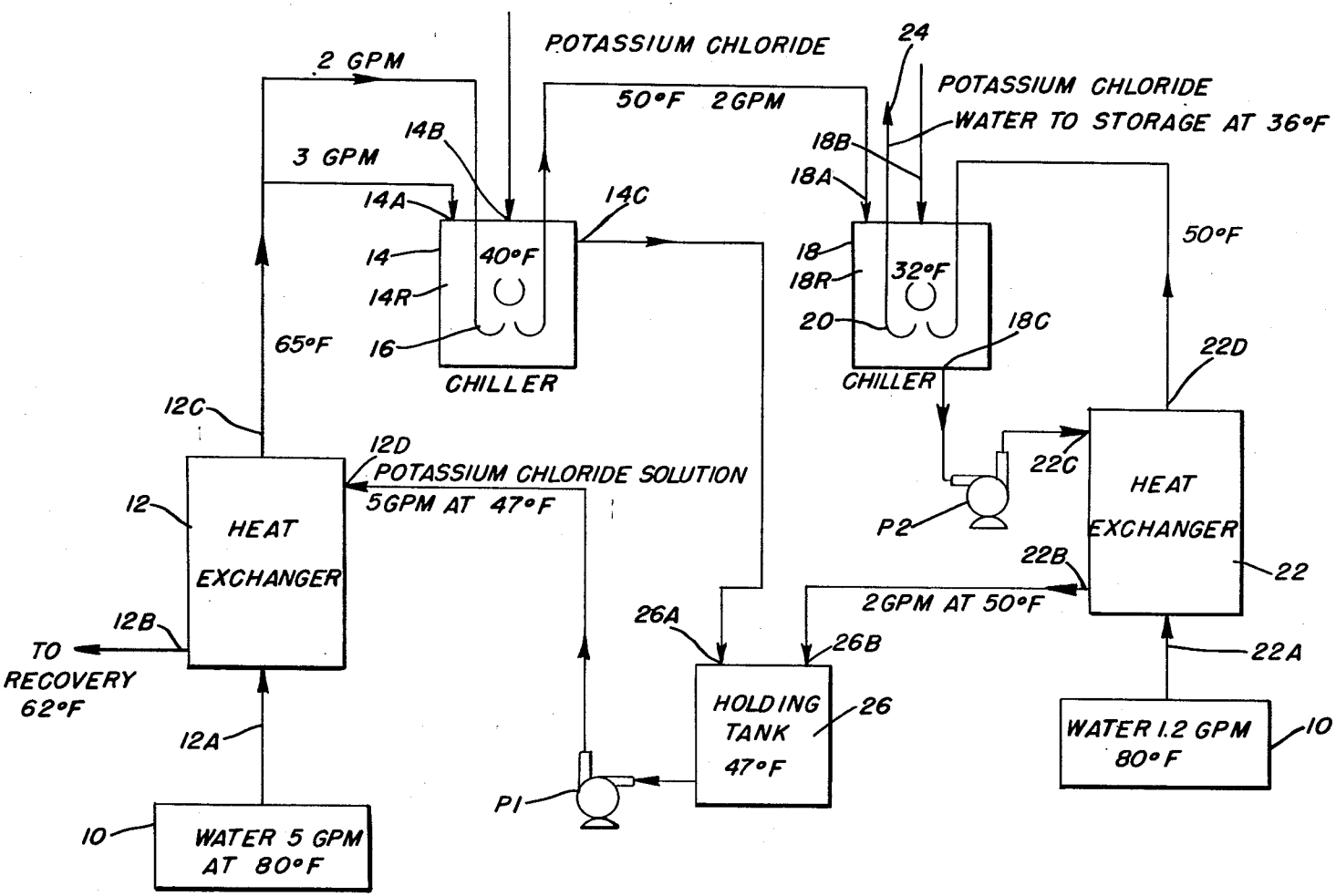
FIG. 2 is one embodiment of a plural-stage, chemical refrigeration system of the present invention suitable for use, for example, in the post-mix beverage dispenser system of FIG. 1.

Before referring directly to the preferred embodiments of the chemical refrigeration system 13, as illustrated in FIGS. 2 and 3, the principles on which the chemical refrigeration system of the present invention operates will be briefly described. The present invention takes advantage of the known fact that certain chemicals, when dissolved in water, produce an endothermic reaction which will cool the water down to a temperature below ambient temperature. The degree of cooling depends on the type of chemical used. Applicant has investigated the behavior of several chemicals, including ammonium chloride, potassium chloride, potassium permangenate, and potassium bromate. More specifically, the behavior of these chemicals dissolved in water with respect to the refrigeration properties has been examined. The refrigeration properties of these chemicals, using ethyl alcohol as a solvent, have also been investigated. The results of these tests are illustrated in the following Table I.

TABLE I

CHEMICAL REFRIGERATION
Examples

| Chemicals | Initial Temperature °F. | Final Temperature °F. |
|---|---|---|
| Ammonium Chloride 40 gms/water 20 ml | 70 | 48 |
| Ammonium Chloride 50 gms/water 100 ml | 68 | 40 |
| Ammonium Chloride 40 gms/water 50 ml | 100 | 58 |
| Ammonium Chloride 40 gms/water 50 ml | 84 | 48 |
| Ammonium Chloride 100 gms/water 300 ml | 92 | 56 |
| Ammonium Chloride 50 gms/water 156 ml | 60 | 28 |
| Ammonium Chloride 80 gms/water 200 ml | 82 | 46 |
| Ammonium Chloride 60 gms/water 150 ml | 52 | 25 |
| Potassium Chloride 15 gms/water 50 ml | 76 | 50 |
| Potassium Chloride 25 gms/water 50 ml | 56 | 30 |
| Potassium Chloride 25 gms/water 50 ml | 76 | 60 |
| Potassium Permangenate 25 gms/water 50 ml | 68 | 60 |
| Potassium Bromate 25 gms/water 50 ml | 68 | 58 |
| Ammonium Chloride 15 gms/water 50 ml | 56 | 30 |
| Ammonium Chloride 15 gms/water 50 ml | 60 | 40 |
| Ammonium Chloride 15 gms/ethanol 50 ml | 71 | 61 |
| Ammonium Chloride 15 gms/water 50 ml | 44 | 22 |
| Ammonium Chloride 10 gms/water 40 ml | 34 | 11 |

The results of this Table indicate that on a pound basis, ammonium chloride dissolved in water produces the most cooling, followed closely by a potassium chloride water system. However, ammonium chloride has been found to be somewhat unstable, so potassium chloride is the preferred embodiment of the present invention.

The above Table also illustrates that the amount of cooling obtained is proportional to the amount of the chemical dissolved in water, which is fixed by the solubility limitations of the chemical. The lower the temperature of the liquid into which the chemical is introduced, the lower the solubility of the chemical is. This limits the amount of cooling one can get at a given temperature, namely the temperature drop or delta.

For example, to 200 ml. of water at 82° F., 80 grams of ammonium chloride was added with very gentle agitation. Within fifteen seconds, the temperature of the solution dropped to 46° F. Since an excess amount of ammonium chloride was used, undissolved salt settled at the bottom of the container. The addition of more ammonium chloride did not lower the temperature any further because of the solubility limitations of the ammonium chloride.

In another example, fifty ml. of fresh water at 44° F. was provided, and 15 grams of ammonium chloride was added. The solution cooled down to 22° F. The addition of more ammonium chloride did not lower the temperature of the water.

In another example, to 40 ml. of fresh water at 34° F., ten grams of ammonium chloride was added, and the solution cooled down to 11° F. The addition of more ammonium chloride did not lower the temperature further.

The results of these experiments show that if one wants to chill water over a large delta, for example, from 82° F. to 11° F., this cannot be achieved in one stage, but it can be achieved in three stages. It is important to note that each stage must chill fresh water for the next stage in order to make it possible to achieve this large temperature drop or delta.

An example of a two-stage system is illustrated in the preferred embodiment of FIG. 2 of the present invention, which will not be described. The chemical refrigeration system of FIG. 2 includes first and second chillers 14 and 18 connected in tandem to chill water from 80 F. from a source 10 to 36° F., as output from the system at 24. A first supply of potassium chloride is input to the first chiller 14 at 14B, and a second supply of potassium chloride is input to the second chiller 18 at 18B. Chiller 14 has a reservoir 14R therein, and chiller 18 has a reservoir 18R therein. Water is supplied from a source 10 at 80° F. to a heat exchanger 12 through inlet 12A. Heat exchanger 12 has another input 12D for receiving waste brine or a potassium chloride solution at approximately 47° F. via pump P1 holding tank 26, inlet 26A thereto, and outlet 14C of chiller 14. Accordingly, it can be seen that the waste brine or first cooling solution from within reservoir 14R is recirculated and applied to heat exchanger 12 at inlet 12D in order to cool the incoming water at 80° F. down to a temperature of 65° F. at outlet 12C of the heat exchanger. A portion of the waste brine is also output at heat exchanger 12 at 12B, and proceeds to a recovery station for recycling the potassium chloride.

Consequently, the water entering the first chiller 14 is at 65° F., rather than 80° F., which enables the potassium chloride added at 14B of chiller 14 to chill the water down 20 to 45° F. A portion of the 65 F. water passes directly into chiller 14 at inlet 14A, and another portion passes into the input end of a coil 16 which passes through reservoir 14R in heat transfer contact with the 45° F. cooling solution therein. Therefore, the liquid or water is further chilled from 65° to 50° in the coil 16, and passes on through inlet 18A into the reservoir 18R of chiller 18. A second supply of potassium chloride is added to chiller 18 through inlet 18B, chills this 50° F. water down to 32° F., creating an even colder cooling solution than present in the first chiller 14. The cooling solution in chiller 18 is recirculated through an output 18C, a pump P2, and an inlet 22C into a second heat exchanger 22. Waste brine from heat exchanger 22 is output at 22B into the holding tank 26 through inlet 26B thereof. Simultaneously, water to be chilled at 80° F. is input to heat exchanger 22 through inlet 22A, wherein it is cooled down to approximately 50° F. by the cooling solution entering heat exchanger 22 from chiller 18. This 50° F. water exits heat exchanger 22 through outlet 22D, and passes through a second cooling coil 20 which is immersed in heat transfer contact within reservoir 18R. Accordingly, water exiting or output from cooling coil 20 at 24 is refrigerated to a temperature of approximately 36° F.

Therefore, it can be seen that the plural stage refrigeration system illustrated in FIG. 2 can successfully cool water from an 80 F. first temperature to a 36° F. second temperature by means of only two chillers, in which first and second supplies of potassium chloride or other selected chemicals are introduced. This 36° F. water output at 24 could, for example, be introduced into the carbonator 15 of the post-mix beverage system of FIG. 1, described hereinbefore.

Referring to FIG. 3, only one chiller stage is utilized to chill water from 80° F. down to 36° F. However, in order to achieve this, larger heat exchangers and chillers must be utilized than in the embodiment of FIG. 1, and, in addition, the cooling solution of the chiller must still be recirculated to initially cool the incoming water down by means of heat exchanger 32 from an initial temperature of 80° F. to 50° F.

As illustrated in FIG. 3, water at a temperature of 80° F. is provided by a source 30 into an inlet 32A of a heat exchanger 32, where it is coupled in a heat transfer fashion to 32° F. brine input at inlet 32D from the output of a pump P3 and outlet 34C of chiller 34. The 32° F. brine chills the 80° F. water down to a temperature of 50° F. at output 32C of heat exchanger 32. Waste brine from the heat exchanger 32 may be output at 32B at a temperature of approximately 72° F. to a recovery station. The recovery station may constitute any suitable means for separating the potassium chloride salt from the water, such as by gas or solar drying devices.

The 50° F. water output from heat exchanger 32 has a portion input through inlet 34A to reservoir 34R of chiller 34, and another portion input to a coil 36 which passes through the cooling solution contained in reservoir 34R. Chiller 34 has a supply of potassium chloride supplied through inlet 34B, which lowers the temperature of liquid in reservoir 34R to a temperature of approximately 32° F. Consequently, when the 50° F. water passes through coil 36, which is immersed in the 32° F. cooling solution of reservoir 34R, water is output at 38 at a temperature of about 36 F.

Many variations may be made in the systems of the present invention embodied in FIGS. 1 and 2, without departing from the spirit and scope of the present invention. For example, the capacities and sizes of the respective heat exchangers, chillers, connecting conduits, and so forth, may be greatly varied to achieve the degrees of cooling required. Also, the flow rates of the liquid between successive stages of the system will be controlled in accordance with the size and heat exchange characteristics of the various devices.

In addition, the pumps, such as P1, P2, and P3, of the systems of the present invention may be powered by various means, such as electrical power or gas power, which may be a biproduct of the carbonation system of the post-mix beverage dispenser of FIG. 1. However, if utilized in outer space, the pumps P1, P2, P3 are preferably powered with electricity.

In addition to its use in outer space for providing refrigeration systems, the present invention may be utilized in underdeveloped countries for providing a low-cost refrigeration system. For example, the chemicals, such as potassium chloride utilized in the chillers of the systems of the present invention, may be recovered and recycled for repeated use. This can provide great cost savings over electrically-powered, mechanical refrigeration systems which are conventional in post-mix beverage dispenser systems now in use.

The chemical refrigeration system described hereinbefore may be further modified, as would occur to one of ordinary skill in the art, without departing from the spirit and scope of the present invention.

What is claimed is:

1. A chemical refrigeration system for chilling a liquid from a first temperature to a second temperature by means of an endothermic reaction of selected chemicals dissolved in said liquid comprising:

(a) a source of liquid at said first temperature;

(b) a source of said selected chemical;

(c) chiller means having reservoir means in which a predetermined quantity of said selected chemical is dissolved in a predetermined quantity of said liquid to create said endothermic reaction and a resulting cooling solution, said cooling solution having a temperature intermediate said first and second temperatures, and a conduit passing through said reservoir means in heat transfer contact with said cooling solution, said conduit having an input end and an output end for passing said liquid to be chilled, said reservoir means having an inlet for introducing said liquid into said reservoir and an outlet for accommodating the flow of said cooling solution out of said reservoir means;

(d) heat exchanger means having a first inlet connected to said source of liquid at said first temperature, a second inlet connected to said outlet of said reservoir means for receiving said cooling solution, a heat exchange chamber for transferring heat between said liquid at said first temperature and said cooling solution to lower the liquid to a temperature intermediate said first temperature and the temperature of said cooling solution, and an outlet for said liquid of intermediate temperature coupled to said input end of said conduit and the inlet of said reservoir means; and (e) pump means for circulating said liquid through said system from said source of liquid to the output end of said conduit, said liquid exiting from the output end of said conduit at said second temperature.

2. The system of claim 1, further including:

(a) second chiller means having a second reservoir for containing a second cooling solution, said first cooling solution being formed by dissolving a first supply of said selected chemical into liquid entering the reservoir means of the first chiller means from said heat exchanger means and said second cooling solution being formed by dissolving a second supply of said selected chemical into liquid in said second reservoir, said liquid in said second reservoir being the liquid at said second temperature supplied from said output end of said conduit which passes through the first reservoir;

(b) second heat exchanger means having a first inlet connected to the source of liquid at said first temperature, a second inlet connected to an outlet from said second reservoir, a heat exchange chamber for transferring heat between said second cooling solution and said liquid at said first temperature to lower the liquid to a temperature intermediate said first temperature and the temperature of said second cooling solution, and an outlet for the liquid coupled to the input end of a second conduit; and (c) said second conduit passing through said second cooling solution in heat transfer contact therewith to cool said liquid to a third temperture below said second temperature, said conduit having an output end for supplying liquid at said third temperature.

3. The system of claim 2, wherein said selected chemical is potassium chloride.

4. The system of claim 2, wherein said selected chemical is from the group consisting essentially of: ammonium chloride; potassium chloride; potassium permangenate; and potassium bromate.

5. The system of claim 1, wherein said selected chemical is potassium chloride.

6. The system of claim 1, wherein said selected chemical is from the group consisting essentially of: ammonium chloride; potassium chloride; potassium permangenate; and potassium bromate.

7. The system of claim 1, further comprising means for providing a zero gravity environment.

8. The system of claim 2, further comprising means for providing a zero gravity environment.

9. A method of refrigerating a liquid from an endothermic reaction of selected chemicals dissolved in said liquid comprising the steps of:

(a) adding a predetermined quantity of a selected chemical into a first solvent in a first reservoir to form a first cooling solution;

(b) transporting a liquid through said first cooling solution to a second reservoir to provide a second solvent at a lower temperature than said first solvent;

(c) adding a predetermined quantity of said selected chemical to said second solvent in said second reservoir to form a second cooling solution having a lower temperature than said first cooling solution; and (d) passing the liquid to be refrigerated through a conduit in heat transfer contact with said second cooling solution.

10. The method of claim 9, wherein said selected chemical is potassium chloride.

11. The method of claim 9, wherein said selected chemical is from the group consisting essentially of: ammonium chloride; potassium chloride; potassium permangenate; and potassium bromate.

* * * * *